US007059804B2

(12) United States Patent
Sieber et al.

(10) Patent No.: US 7,059,804 B2
(45) Date of Patent: Jun. 13, 2006

(54) DRAINAGE DEVICE

(75) Inventors: Michael Sieber, Timmaspe (DE); Markus Blaschke, Fockbek (DE); Heino Messerschmidt, Lutjenwestedt (DE); Arne Stoltenberg, Budelsdorf (DE)

(73) Assignee: ACO Severin Ahlmann GmbH & Co. KG, Rendsburg (DE)

( * ) Notice: Subject to any disclaimer, the term of this patent is extended or adjusted under 35 U.S.C. 154(b) by 52 days.

(21) Appl. No.: 10/491,574

(22) PCT Filed: Oct. 2, 2002

(86) PCT No.: PCT/EP02/11085

§ 371 (c)(1),
(2), (4) Date: Apr. 2, 2004

(87) PCT Pub. No.: WO03/031736

PCT Pub. Date: Apr. 17, 2003

(65) Prior Publication Data

US 2004/0240941 A1 Dec. 2, 2004

(30) Foreign Application Priority Data

Oct. 4, 2001 (DE) ..... 101 48 823

(51) Int. Cl.
*E03F 3/04* (2006.01)

(52) U.S. Cl. ..... 405/118; 404/2

(58) Field of Classification Search ..... 405/118, 405/119; 404/2, 3, 4
See application file for complete search history.

(56) References Cited

U.S. PATENT DOCUMENTS

| | | | | |
|---|---|---|---|---|
| 4,630,966 | A * | 12/1986 | Karbstein | 405/118 |
| 4,699,544 | A * | 10/1987 | Karbstein | 405/118 |
| 5,106,231 | A * | 4/1992 | Thomann | 405/119 |

FOREIGN PATENT DOCUMENTS

| | | |
|---|---|---|
| DE | 88 04 073 | 7/1989 |
| DE | 40 07 296 | 9/1990 |
| DE | 42 37 237 | 5/1993 |
| DE | 195 26 985 | 2/1996 |
| DE | 44 36 460 | 4/1996 |
| DE | 196 30 841 | 2/1998 |
| DE | 298 07 197 | 8/1998 |
| DE | 197 31 585 | 1/1999 |

* cited by examiner

*Primary Examiner*—Frederick L. Lagman
(74) *Attorney, Agent, or Firm*—Merchant & Gould P.C.

(57) ABSTRACT

The invention relates to a drainage device for surface drainage, in particular to drainage channels with a channel body and a frame which fits on an upper edge of the channel body, comprising an outer arm and an inner arm between which the upper edge of the channel body sits, for housing a cover. According to the invention, simple economic production and assembly of the frame on the channel body may be guaranteed whereby the frame is embodied such as to be able to be cast within the body of the channel body on the casting thereof, or alternatively, may be fixed to the channel body by means of continuous jointing to a pre-fabricated channel body.

14 Claims, 4 Drawing Sheets

DRAINAGE DEVICE

RELATED U.S. APPLICATIONS

This application is a national stage filing of corresponding PCT application No. PCT/EP02/11085 filed Oct. 02, 2002 and designating the U.S.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to a drainage device for surface drainage according to the precharacterizing clause of claim 1.

BACKGROUND OF THE INVENTION

Some known drainage devices comprise a frame that can be fixed to the channel body. The frame so attached serves to reinforce the upper edge of the channel body and also provides a surface on which the cover is seated. The frame is made of metal and fixed to the channel body.

The German patent DE 40 07 296 C2 discloses a drainage channel in which a frame set onto the upper edge of the channel body is kept in place by external and internal arms of the frame that enclose the wall of the channel body. In addition, the frame is provided with an anchoring projection attached to one of the arms, which when the frame is in the completely installed state engages with an insertion groove that runs within the edge of the channel, so that a bayonet-like connection is produced between the frame and the channel body. However, this drainage channel is very expensive to manufacture, because each frame must be constructed to correspond to the dimensions of the particular channel body.

BRIEF SUMMARY OF THE INVENTION

It is thus the object of the present invention to develop a drainage device of the kind cited above further in such a way that a firm connection of the frame to the channel body is ensured by an arrangement that can be assembled by simple means and is economical to manufacture.

This object is achieved by the drainage device given in claim 1.

It is the aim of the invention to construct the frame so that the frame as a whole can be attached to the channel body as part of the process of casting the body, or alternatively can be adhered to a previously manufactured channel body and thereby be firmly connected to the body. Thus the frame can be both connected by adhesive to a prefabricated channel body and also connected thereto during the casting of the channel body. Because in both cases the frame is identically constructed, it can be produced in considerably larger numbers, which provides a great economical advantage in the manufacture of the drainage device.

Preferably a fixing projection serves as a spring element by means of which a fixing section of the frame, which is continuous with the fixing projection, is pressed against the prefabricated channel body. Thus when put into place on the upper edge of the channel body, the frame is connected thereto in a form-fitting manner. An attachment of frame to channel body by adhesive hence proves to be extremely advantageous, because after adhesive material has been inserted between frame and channel body, the frame remains pressed against the channel body independently, without the assistance of an externally imposed pressing force. As a result, a thin film of adhesive material is formed, by means of which a uniform and permanently firm adhesive connection is achieved.

Preferably the prefabricated channel body is provided, in the region enclosed by the outer arm of the frame, with a furrow through which adhesive material can be injected. The adhesive is injected into the furrow after the frame has been set onto the upper edge. Above a certain injection pressure, the adhesive penetrates uniformly into the region between outer arm and channel body where, assisted by the uniform pressure exerted by the frame, it spreads out very thinly and uniformly. As a result, the adhesive material hardens very well and ensures firm connection.

Preferably the frame is so constructed that when the channel body is being cast with a mold, regions of the outer arm and/or the inner arm of the frame act as a sealing surface with respect to the mold. Hence the molds do not need any edges, offsets or projections for sealing during the casting process, so that the molds can be mostly of flat construction and the frame remains free of casting material in the region where the grating is to be seated.

The frame is so constructed that it can be form-fitted onto the prefabricated channel body. Thus the frame can be mounted on the channel body rapidly and simply.

It is preferred for the frame to be made in one piece from a strip of material, in particular sheet steel of similar sheet metal. Of course, one can also resort to other materials for constructing the frame. When a single strip of material is used, the frame can be rapidly and simply produced by rolling the material. Alternatively, the frame can also be made of plastic material. Other advantages are that the frame's radii facilitate cleaning, and that it is highly resistant to corrosion.

The frame preferably comprises a fixing projection that runs uniformly along the entire length of the inner arm of the frame, to hold a catch means associated with the cover. A considerable advantage consists in the facts that manufacture can be simplified and the position of the catch means on the cover can be freely determined. The cover should preferably comprise at least two catch means, one situated at each of the end regions of the cover. Depending on the type of construction and/or the intended site of the drainage channel, more than two catch means can be provided on the cover.

Preferably the fixing projection is so formed that it can receive casting material. Here it is a considerable advantage that after hardening of the casting material, depending on the amount of such material that has accumulated within or behind the fixing projection, the frame is firmly connected to the channel body.

Preferably the frame comprises an integral fold that is continuous with the fixing section and together with the outer arm forms an insertion section such that the frame can be set onto the prefabricated channel body by means of a force acting from above. When it has been put completely into place on the channel body, pressure between the fixing section and the outer arm holds the frame to the channel body. That is, the frame can be set onto the channel body in a form-fitting manner. Installation of the frame proves to be a very rapid and simple procedure, because the frame is set into place only by a force acting from above, with no need for the inner arm and/or the outer arm to be held apart during the installation.

In a preferred embodiment the integral fold is so formed that during casting of the channel body, an outer edge of the integral fold makes form-fitting contact with a surface of the mold. The outer arm, during this casting process, preferably is in form-fitting contact with the mold. As a result, casting of the channel body can be rapidly and simply accomplished.

Preferably the outer arm comprises openings into which casting material can flow during casting of the channel body. After the casting material has hardened, a firm connection of the frame to the channel body is ensured.

It is preferred for the adhesive material to be injected into the furrow by way of a bore in the outer arm of the frame. For this purpose a specially constructed injection nozzle for adhesive material is placed against the bore, through which the adhesive material is injected into the furrow. By distributing the injection over several bores, the distribution of the adhesive material within the furrow is made particularly uniform.

The prefabricated channel body is preferably provided in the region of the inner arm with an indentation of its material. This measure results in improved adhesion, because the indentation forms a reservoir for the adhesive.

Other preferred embodiments of the invention will be apparent from the subordinate claims and the following description of preferred embodiments. These are explained in greater detail with reference to drawings, wherein

DETAILED DESCRIPTION OF THE INVENTION

Figure 2:
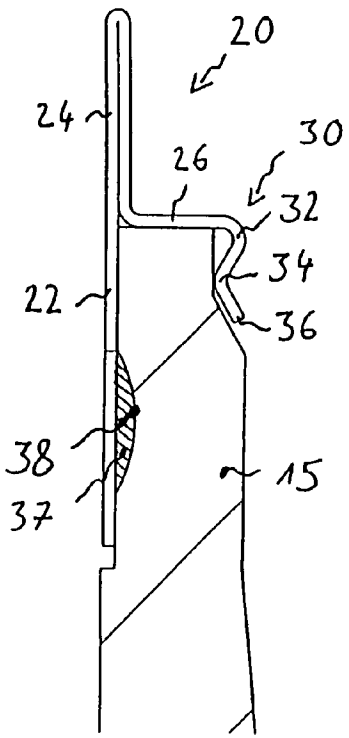
FIG. 2 is an enlarged partial view of FIG. 1 showing the frame set onto the body.

In the following description, the same reference numerals are used for identical parts or parts with identical actions.

Figure 1:
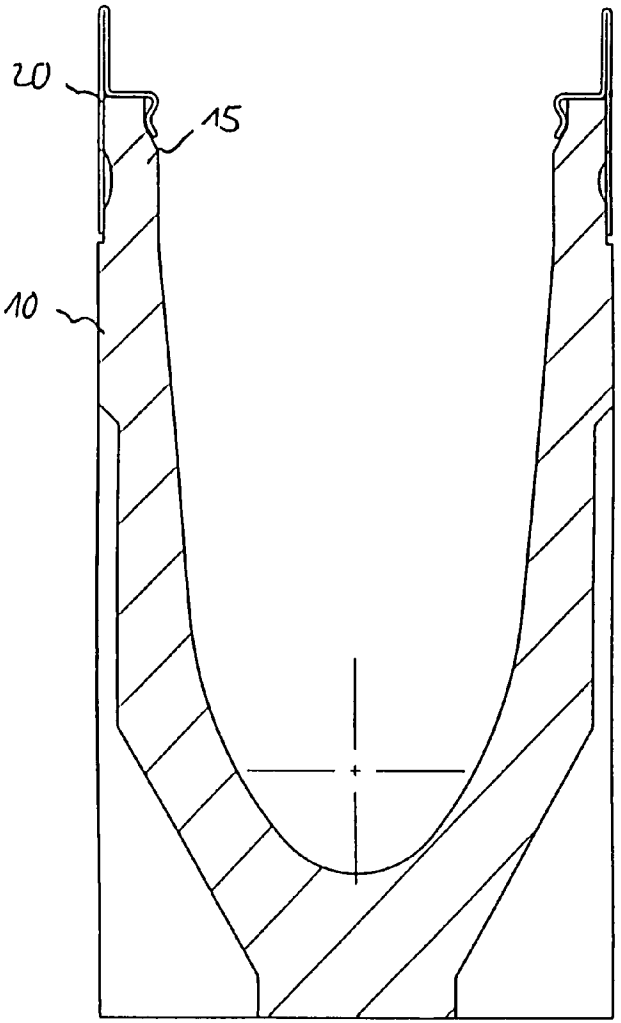
FIG. 1 is a cross sectional view through a prefabricated channel body onto which a frame has been set.

FIG. 1 shows a cross section through a channel body 10 with a frame 20, which has been set into position on an upper edge 15 of the channel body 10. The channel body is made of concrete polymer, normal concrete or a similar castable material. The frame 20 is preferably made in one piece from a strip of material, in particular sheet steel or a similar metal. Preferably the strip of material is rolled in order to produce the frame 20. The frame serves to receive a cover, not shown in the figure, as well as to reinforce the upper edge 15.

FIG. 2 shows an enlarged partial cross section, with the frame 20 in position as in FIG. 1. The single piece shaped to form the frame 20 consists of an outer arm 22, which is apposed to the outer surface of the upper edge 15, a side 4 wall 24, which is constructed as an extension of the outer arm 22 projecting beyond the upper edge 15 and folded over by 180°, a bearing surface 26 continuous therewith and finally an inner arm 30. The inner arm 30 is composed of a fixing projection 32, followed by a fixing section 34 and an integral fold 36.

The fixing projection 32 serves as a spring element to press the fixing section 34 against the upper edge 15 of the channel body 10. The integral fold 36 is bent at an angle such that the integral fold 36 and the outer arm 22 together form an insertion section. Hence the frame 20 can be set onto the upper edge 15 merely by applying a force from above. The angle of the integral fold 36 with respect to the vertical is preferably between 30° and 60°. Thus the inner arm 30 forms a groove into which a catch means (not shown here) can be "snapped" so that it is retained. This catch means is made of a deformable material, in particular sheet steel, and is resiliently seated. The catch means can alternatively be made of plastic. The shoulder formed by the side wall can, depending on production constraints, be constructed as a hollow ridge (not shown).

The surface of the outer arm 22 is flush with the surface of the upper edge 15. The upper edge 15 is provided with a furrow 38 in the region of the outer arm 22. After the frame 20 has been set into position, adhesive material 37 is injected into this furrow 38, and after a certain pressure has been reached, the adhesive runs into the region between the outer arm 22 and the upper edge 15. Because the outer arm 22 is being pressed against the upper edge 15, the area is covered with only a thin film of adhesive, which in combination with the high pressure being applied by the frame produces a firm and long-lasting adhesive connection. The furrow 38 can be formed so that it extends along the entire channel, in which embodiment the adhesive material 37 is injected from two sides. In another embodiment the furrow 38 is not continuous over the entire length of the channel body 10, in which case the adhesive material 37 is injected at one side of the opening. Another embodiment for attaching the frame 20 to the upper edge of the channel body 10 by adhesive is shown in FIG. 3.

Figure 3:
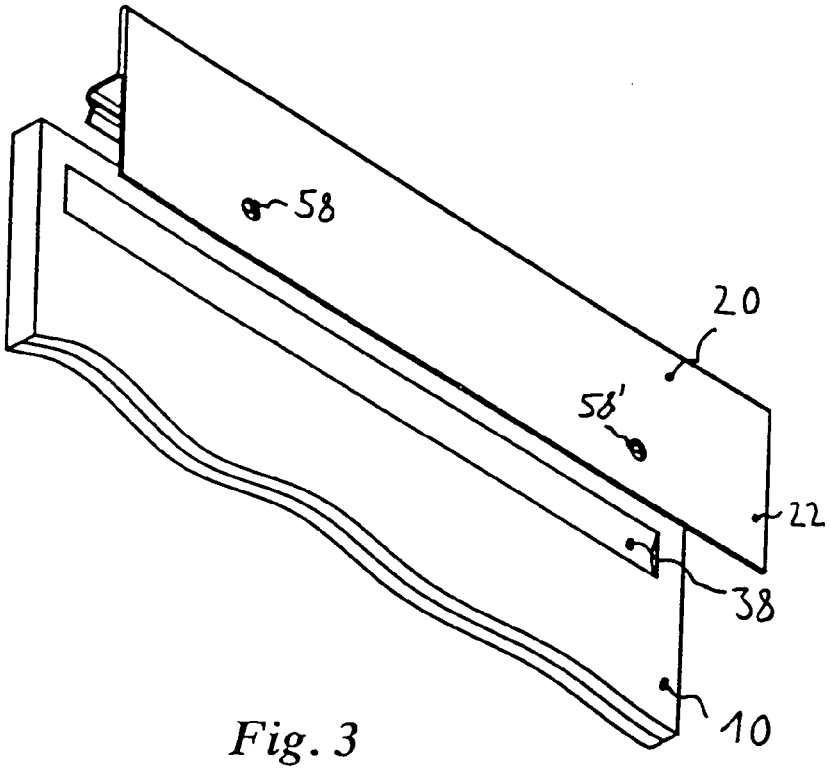
FIG. 3 is a view of a channel body and a frame provided with bores, with the frame not set into position.

FIG. 3 shows a perspective view of the channel body 10 and the frame 20, in which the frame 20 has not yet been set onto the upper edge of the channel body 10. The frame 20 in this embodiment is provided with bores 58, 58' in its outer arm 22. To these bores an injection nozzle is applied, as shown in FIG. 4, in order to inject the adhesive material 37 into the furrow 38.

Figure 4:
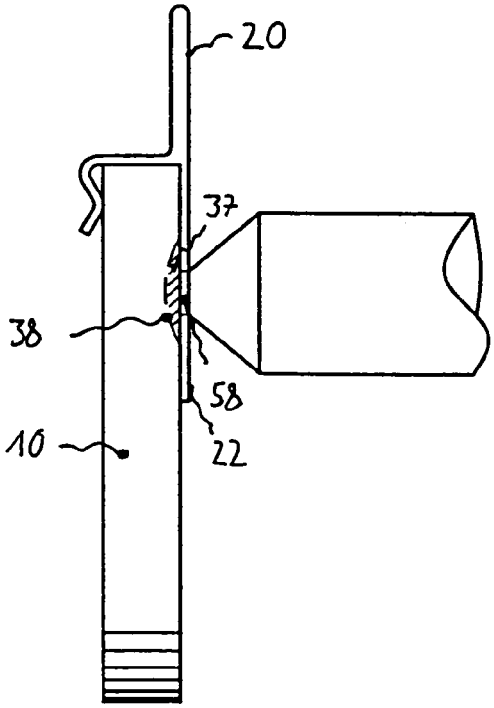
FIG. 4 shows an embodiment wherein a frame is being connected by adhesive to the upper edge of a channel body.

FIG. 4 shows a sectional view of the channel body 10 with the frame 20 in place. The injection nozzle has been applied to the bore 58 in the outer arm 22. The construction of the injection nozzle is such that when in this position, it seals off the bore completely, so that the adhesive material 37 can be injected into the furrow 38 under high pressure, whereupon the adhesive material 37 becomes particularly uniformly distributed.

Figure 5:
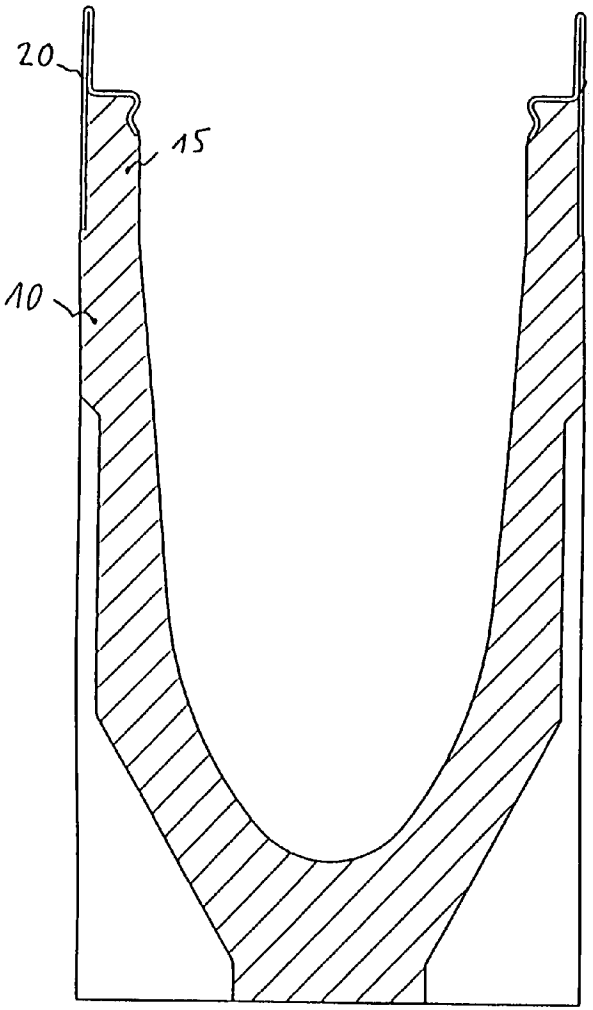
FIG. 5 is a cross section through a channel body with a frame cast into the upper edge of the channel body.

FIG. 5 shows a cross section through the channel body 10 with frame 20, which has been cast into the channel body 10. The frame 20 is so constructed that during casting of the channel body 10 with a mold 50, regions of the outer arm 22 and the inner arm 30 of the frame 20 act as sealing surfaces with respect to the mold 50.

Figure 6:
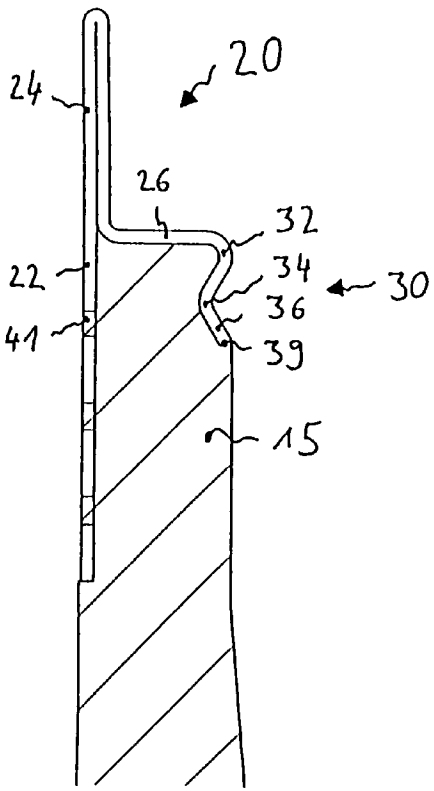
FIG. 6 is an enlarged partial view of FIG. 5 showing a cast-in frame.

FIG. 6 shows an enlarged partial cross section according to FIG. 5. The fixing projection 32 is so constructed that casting material accumulates in the region formed by the fixing projection 32. After the casting material has hardened, the frame 20 can no longer be taken off the upper edge 15. The integral fold 36 is so formed that during casting of the channel body 10, an outer edge 39 of the integral fold 36 makes form-fitting contact with the surface of the mold 50. Similarly, the outer arm 22 is form-fitted against the surface of the mold. The outer arm 22 comprises openings 41 into which, during casting of the channel body 10, the casting material can flow. After the casting material has hardened, the material in the openings 41 constitutes a means of fixing the frame 20 to the upper edge 15 of the channel body 10.

Figure 7:
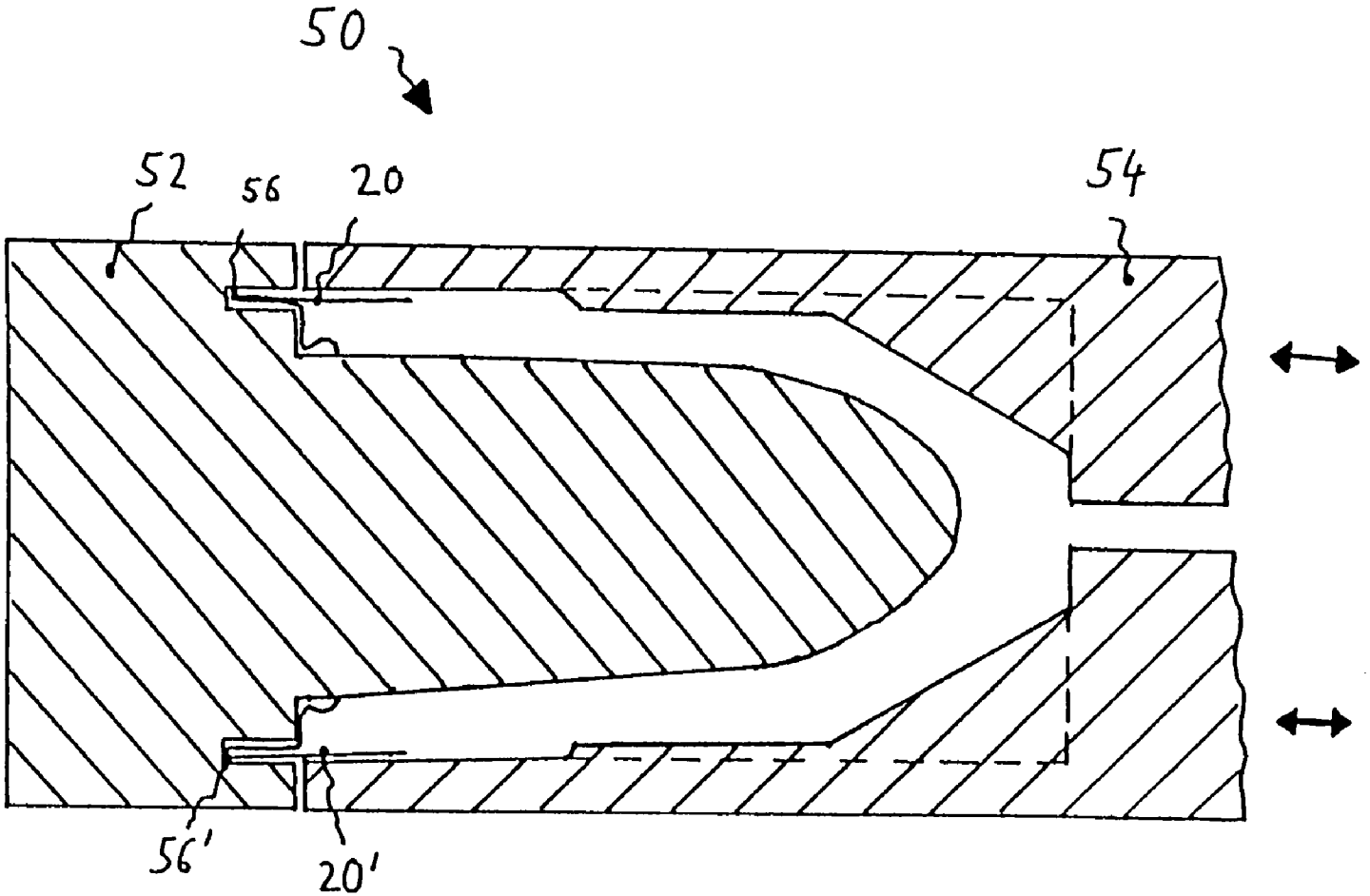
FIG. 7 is a partial cross section through a mold for casting a channel body.

FIG. 7 shows a partial cross section of the mold 50 for casting the channel body 10, in an exemplary embodiment. The mold 50 consists of a stationary first half-mold 52 and a movable second half-mold 54. The two halves 52 and 54 of the mold are constructed such that when they are closed together, they enclose a space with the shape of the channel body 10. The first half-mold is provided with two apertures 56 and 56', into each of which a frame 20 is inserted before the channel body 10 is cast. These frames are so shaped that during casting of the channel body 10, an outer edge of the integral fold 36 is apposed in a form-fitting manner to the surface of the first half-mold 52, and the outer arm 22 is apposed in a form-fitting manner to the surface of the second half-mold 54.

LIST OF REFERENCE NUMERALS

10 Channel body
15 Upper edge
20 Frame
22 Outer arm
23 Side wall
26 Bearing surface
30 Inner arm
32 Fixing projection
34 Fixing section
36 Integral fold
37 Adhesive material
38 Furrow
39 Outer edge
41 Opening
50 Mold
52 First half-mold
54 Second half-mold
56, 56' Aperture
58, 58' Bore

The invention claimed is:

1. A drainage device for surface drainage comprising:

a channel body defining a drainage channel, the channel body including an upper edge and a furrow configured to accept an injection of adhesive material;

a frame attached to the upper edge of the channel body, the frame including an outer arm and an inner arm, the upper edge of the channel body configured to receive a cover between the inner arm and the outer arm, the furrow of the channel body being proximate a portion of the outer arm, the portion of the outer arm being planar and extending over the furrow, the frame constructed to fixedly connect to the channel body by being entirely cast into the channel body during casting of the body; or by attachment to a prefabricated channel body by the adhesive material.

2. The drainage device according to claim 1, wherein the frame includes a fixing projection formed as a spring element to press a fixing section of the frame continuous with the fixing projection against the prefabricated channel body.

3. The drainage device according to claim 1, wherein the frame is constructed such that during casting of the channel body in a mold, regions of the outer arm and the inner arm of the frame act as a sealing surface with respect to the mold.

4. The drainage device according to claim 1, wherein the frame is constructed to mount onto the prefabricated channel body in a form-fitting manner.

5. The drainage device according to claim 1, wherein the frame is made in one piece out of a strip of material.

6. The drainage device according to claim 2, wherein the fixing projection runs uniformly along an entire length of the inner arm of the frame to hold a catch means on the cover.

7. The drainage device according to claim 6, wherein the fixing projection is constructed to receive casting material.

8. The drainage device according to claim 6, wherein the frame includes an integral fold continuous with the fixing section, the integral fold and the outer arm defining an insertion section configured to enable the frame to be set onto the prefabricated channel body by application of a force from above, the frame being pressed against the channel body by the fixing section and the outer arm when the frame is completely set onto the channel body.

9. The drainage device according to claim 8, wherein the integral fold is constructed such that during casting of the channel body an outer edge of the integral fold is apposed in a form-fitting manner to a surface of a mold for the channel body.

10. The drainage device according to claim 3, wherein the outer arm is apposed in a form-fitting manner to the surface of the mold during casting of the channel body.

11. The drainage device according to claim 1, wherein the outer arm defines openings constructed to receive casting material during casting of the channel body.

12. The drainage device according to claim 1, wherein the outer arm defines a bore to facilitate the injection of the adhesive material into the furrow.

13. The drainage device according to claim 1, wherein the material of the prefabricated channel body is provided with an indentation in a region of the inner arm.

14. The drainage device according to claim 5, wherein the frame is rolled from a strip of sheet metal.

* * * * *